US005956900A

United States Patent [19]

Madsen

[11] Patent Number: 5,956,900

[45] Date of Patent: Sep. 28, 1999

[54] SECURITY GRATING

[75] Inventor: Mogens Madsen, Tjele, Denmark

[73] Assignee: ALG Sikring Abonnmentservice ApS, Viborg, Denmark

[21] Appl. No.: 09/025,259

[22] Filed: Feb. 18, 1998

[30] Foreign Application Priority Data

Feb. 21, 1997 [DK] Denmark ..... 0192/97

[51] Int. Cl.[6] ..... E06B 3/68

[52] U.S. Cl. ..... 49/56; 49/67; 49/50

[58] Field of Search ..... 49/55, 50, 52, 49/53, 56, 61, 63, 67, 394

[56] References Cited

U.S. PATENT DOCUMENTS

| | | | |
|---|---|---|---|
| 4,249,345 | 2/1981 | Littleton | 49/56 |
| 4,384,428 | 5/1983 | Cox | 49/56 |
| 4,630,396 | 12/1986 | Zvi et al. | 49/56 X |
| 4,644,688 | 2/1987 | Benderoff | 49/67 |
| 4,671,012 | 6/1987 | Merklinger et al. . | |
| 4,685,316 | 8/1987 | Hicks et al. | 49/56 X |
| 4,937,975 | 7/1990 | Zilkha | 49/56 |
| 5,018,302 | 5/1991 | Kluge | 49/55 X |
| 5,056,262 | 10/1991 | Schweiss et al. | 49/67 X |
| 5,289,655 | 3/1994 | Marmora et al. | 49/56 X |
| 5,339,567 | 8/1994 | Pierpont et al. . | |

FOREIGN PATENT DOCUMENTS 502063 11/1993 Sweden .

*Primary Examiner*—Jerry Redman
*Attorney, Agent, or Firm*—Watson Cole; Grindle Watson, PLLC

[57] ABSTRACT

A security grating (1) for securing store windows (2) is constituted of a mesh (3) of overlaying horizontal bars (4) and vertical bars (5). The security grating further comprises a vertical frame member (6) on each lateral edge. The frame member (6) has a recess (10) with a depth corresponding to at least half the mesh width (9) between vertical bars. Thus, the mesh can always be cut so that the outermost vertical bar is located in the recess (10). As the vertical bar (5) can be positioned at an arbitrary depth in the recess (10) there are no specific requirements for exact tolerances when mounting the security grating (1) around a window (2).

15 Claims, 7 Drawing Sheets

SECURITY GRATING

BACKGROUND OF THE INVENTION

The present invention relates to a security grating for wall openings in a building, preferably for store windows and doors, wherein a grating of intersecting bars is mounted on a frame comprising at least two frame members, which in use are adapted for substantially vertically oriented mounting on either side of the wall opening and which have a recess for loosely receiving parts of the grating, and which comprise connecting means adapted to connect with corresponding connecting means on the building or on a mounting frame secured to the building.

Security gratings are used to secure doors and windows against breaking in. The frame is mounted on the wall inside the window or the door to secure goods and contents in stores.

The gratings are typically used by dismounting the gratings during the day time to allow customers an unbarred view of the goods on display in the store. The security gratings are placed in front of windows and doors at night to secure the goods in the store. Thus, it answers the purpose that such a security grating may in a relatively simple and easy manner be mounted on and demounted from the building. Furthermore, it is important with a relatively effective and secure fastening of the grating to the building, to prevent an intruder from loosening the grating from the frame.

The generally known security gratings are secured to the wall or to a mounting frame around the window by use of hook means placed in lugs. The grating may consequently be secured against removal by placing padlocks or the like through the hooks, to prevent the latter from being lifted from the lugs.

Thus, security gratings are known that are manufactured from standard meshes, typically of a mesh width of 10 cm, and manufactured from intersecting and welded round bars. When a customer orders a security grating which is to fit a particular wall opening, such as a door or a window, a specified size of mesh, corresponding to the wall opening to be protected, is cut out. Then, a frame is welded onto at least the two vertical sides of the mesh to make up the security grating. Then, hooks are welded or screwed onto the two vertical frame members, that are usually made from flat bars.

This manufacturing process is not advantageous, as it is relatively slow and at the same time requires individual adjustment of each individual security grating. This individual adjustment of each individual security grating is necessary for a precise fitting of the hooks in relation to mounting lugs in the wall or in a mounting frame around the the window or the door. The actual cutting and welding of the individual elements is time consuming. Furthermore, the actual result will not have an estheticly pleasing finish as is to be desired in many stores in order for the security grating to have the same esthetic appearance as the rest of the store fittings.

An example of gratings of the type mentioned in the introduction, adjustable to fit the width of the wall opening, is known from the Swedish Patent No. 502.063. A grating according to this patent includes vertical telescoping rods adapted for telescoping with one another. These vertical sections support horizontal bars in the form of branches on U-shaped sections. The ends of the U-shaped sections may be loosely received in a recess in vertical frame members at the outer sides of the grating. By sliding the U-shaped sections in grooves, said U-shaped sections being overlaid in central, vertical sections, it becomes possible to adjust the width of the frame. Furthermore, the telescopic engagement of the vertical sections will make it possible to adjust the height of grating. Thus, with the grating it becomes possible to make individual adjustments to fit the width and the heigth of the wall opening that needs to be protected.

However, the construction is fairly expensive and is not suitable for the manufacture of gratings using standard mesh. Furthermore, a simple and easy securing of the security grating to the building is not provided for.

SUMMARY OF THE INVENTION

It is the object of the present invention to provide a security grating of the type mentioned in the introduction, the grating being manufactured as a prefabricated mesh with a predefined mesh width, and allowing for a simple and fist adjustment for a particular wall opening, and being at the same time relatively cheap to manufacture. At the same time the security grating should appear estheticly and allow for secure fastening to the building or the mounting frame.

According to the present invention this is achieved by a security grating wherein the grating is constituted of overlaying and intersecting bars, the one set of which, comprising preferably vertical bars, is disposed with equidistant mesh widths, wherein the recess of the frame member is an elongated recess, with a depth corresponding to half the mesh width, a width corresponding to the thickness of the overlaying bars, and an entry opening corresponding to the thickness of the horizontal bars.

With this construction it is possible to store meshes of a few standard heights corresponding to the standard height of windows and doors and likewise store frame members of a length corresponding to these standard heights. The individual meshes can be kept in store in such lengths as are available from the manufacturer. From this length of mesh a section is cut out substantially corresponding to the width of the specified security grating. As the recess has a depth corresponding to half the mesh width, it will be possible to fit the outermost vertical bar to different depths in the recess whereby an individual adjustment of the security grating may be achieved.

Thus, it will always be possible to cut the mesh to a specified width and in doing so the outermost vertical bars will be fitted closest to the bottom of the recess or the entry opening of the recess depending on the exact positioning of the fastening means on the building. Thus, the vertical frame members may be slidingly aligned to fit exactly with the fastening means fitted to the building or to a mounting frame.

According to one embodiment, the entry opening of the recess is made in the longitudinal direction of the frame member. In this embodiment the frame member can be lowered down over the outermost vertical bar on either side of the grating.

The actual manufacture of the security grating is very fast as all that is needed is to fit a frame member over the outermost vertical bar on either side of the grating. Then the grating may be fixedly secured in place, for example by means of a screw screwed through the recess to prevent mutual displacement of the frame member and the grating in the upward direction of the grating. However, relative longitudinal movement to adjust the security grating to the particular wall opening is possible.

According to a second embodiment, the entry opening of the recess is made in the form of one or more entry openings that are made at the lateral edge of a U-shaped channel member which can be closed by means of a lid releasably hinged at the same lateral edge as where the entry openings are positioned transversely oriented to the recess. The manufacture of a security grating of this type is also fast as all that is needed is to fit the outermost vertical bar inside the frame member and position the horizontal bars in the entry openings. Then the grating can be secured relative to the frame member by closing the latter with a hinged lid locked to the U-shaped channel member.

The U-shaped channel member can be adapted for mounting directly on the building, for example, by using connecting means in the form of screws, expansion bolts or the like. Where this is the case, the manufacture of the security grating will not require a specific fastening of the frame member over the mesh. Thus, all that is required is a cutting of the mesh to a specified size. This mesh is fitted in the U-shaped channel member secured directly to the building. After the mesh has been fitted in the channel member, the latter is closed by means of the lid. Thus, the grating is mounted. In this embodiment the channel member can be said to make up a combined frame member/mounting frame. This embodiment is particularly simple and cheap and at the same time gives an estheticly pleasing appearance towards the interior of the store.

On removing the grating, all the user has to do is to unlock the lid and release the hinge. Then the grating can be freely removed from the channel member.

If a mounting frame is used around the wall opening, the mounting frame will preferably be made of sections that are also stored in standard lengths corresponding to the standard lengths of the vertical frame members of the grating. It will be easy to fit the mounting frame on either side of the wall opening due to the possibility for adjustment provided by the vertical frame members of the security grating.

According to one embodiment, the connecting means between the security grating and the building consist of a projecting pin and a contacting recess. It is optional whether the pin or the recess is placed on the frame member of the security grating or on the building/mounting frame. However, in the preferred embodiment the recess is made in the frame member of the security grating and the pin projects from a mounting frame. Once the security grating is placed inside such a mounting frame by hooking the recess over the pin, there will be no projecting parts from the mounted security grating. Thus, the security grating appears with an aestehtically pleasing plane surface facing the store area.

As the projecting pin is preferably placed in the frame and an inclining recess is made in the downward lateral edges of the vertical frame members, the frame member will on account of its own weight be weighed down and get into contact with the frame, while at the same time the pin is located in the bottom of the recess. Thus, the grating will be very easy to mount. The subsequent locking of the grating in its position inside the frame is very simple, for example, by use of a lock cylinder, adapted to extend across the recess behind the engaging connecting pin when in locked position.

BRIEF DESCRIPTION OF THE DRAWINGS

The invention, will now be explained in detail with reference to the accompanying schematic drawing, in which.

DESCRIPTION OF THE INVENTION

Figure 1A:
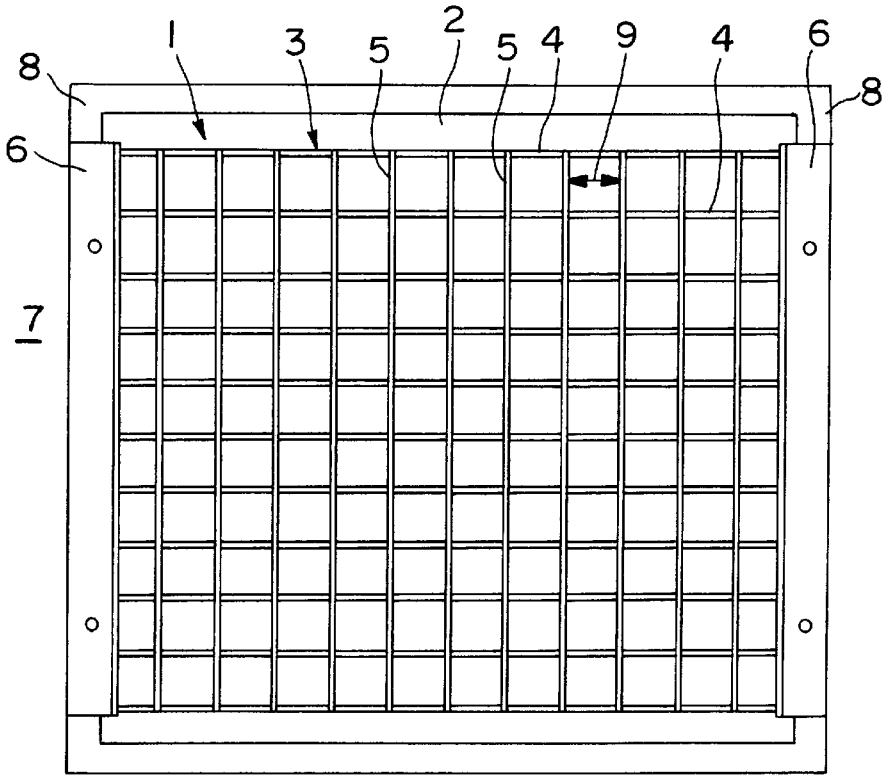
FIGS. 1A and 1B show a schematic view and a transverse sectional view, respectively, illustrating a security grating fitted over a wall opening cross hatching is omitted for clarity except in connection with the larger structure such as the window frame and the building.
Figure 1B:
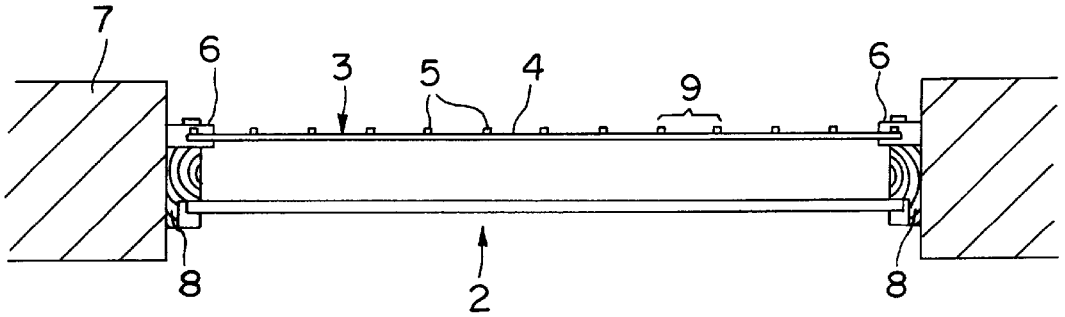

FIGS. 1A and 1B depict a security grating 1, which is placed over a wall opening in the form of a window opening 2. The security grating 1 includes a mesh 3, made up of a number of horizontal bars 4 and a number of vertical bars 5. The bars are mounted in a frame, composed of two vertical frame members 6. The frame members 6 are secured to the building 7 by means of a mounting frame made up of two vertical frame members 8 on either side of the window opening 2.

The frame members 6 and the mounting frame 8 may be shaped differently, as explained in the following. Likewise, it will be possible to use a single member constituting at the same time a mounting frame and a frame member for the mesh 3.

The horizontal and vertical bars 4, 5 are positioned overlaying, all vertical bars 5 being placed on the same side of all horizontal bars 4. The vertical bars 5 are positioned with an equidistantly spaced mesh width 9, which in the shown embodiment is 10 cm, but which may vary between 5 and 15 cm. The mesh is manufactured from welded round bars. The frame members 6 and the mounting frames 8 are manufactured from extruded aluminum sections. Alternatively, other materials may be used including composite materials.

Figure 2:
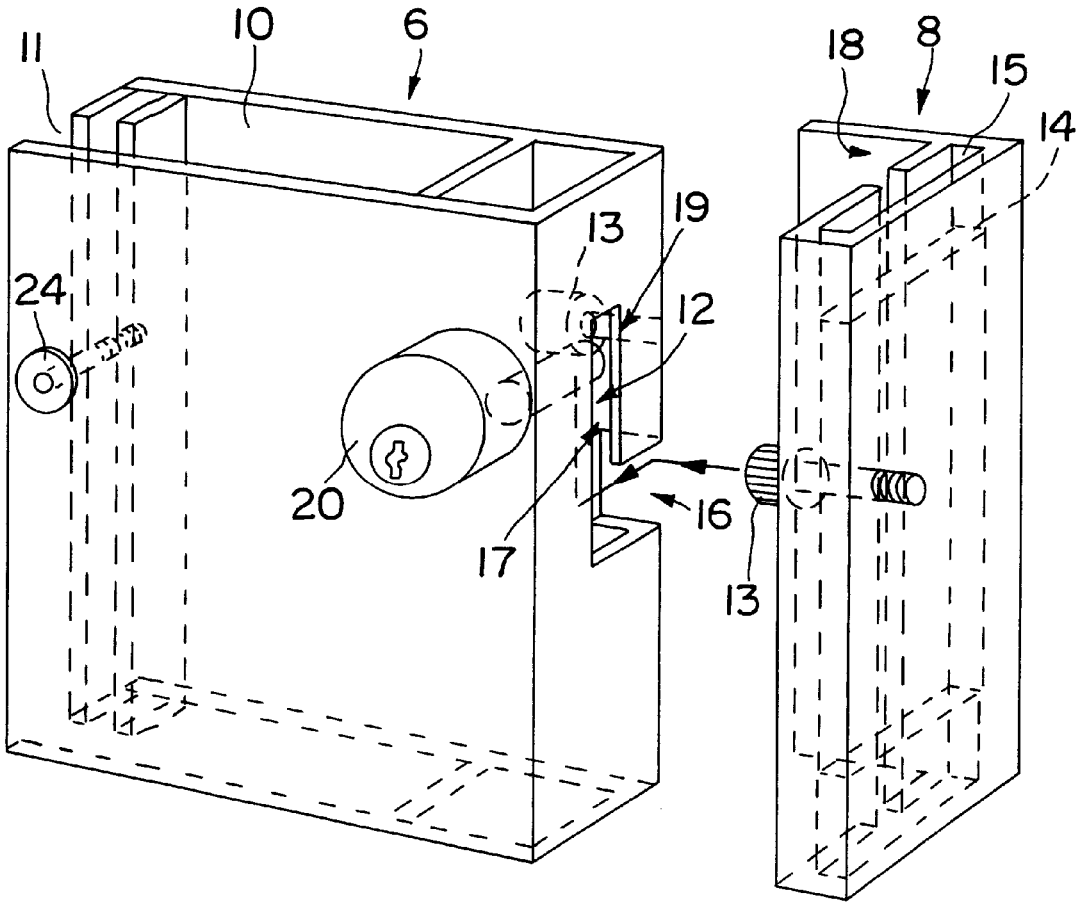
FIG. 2 shows a partial perspective view illustrating connecting means on a frame member and a section for a mounting frame.

FIGS. 2 and. 3 show a frame member which is made and having a recess 10 with an entry opening 11 that is parallel to the length of the recess 10. The recess 10 is substantially d-shaped as the opening 11 is located at the one side of the recess. At the lateral edge of the frame member opposite the entry opening 11 a recess 12 is formed, which is adapted to connect with a pin 13 secured to a mounting frame 8. The pin 13 is made of a screw placed in a slide block 14, which may be slidably fitted in a recess 15 in the mounting frame. This allows for an individual adjustment of the height at which the security grating 1 is mounted.

The recess 12 in the frame member 6 has a mouth 16 at its lower side and has an upwardly slanting part 17. When mounting the security grating, it will thus, on account of its own weight, be weighed down and get in contact with a flange 18 on the mounting frame 8. Once the pin 13 is located in the bottom 19 of the recess 12, a lock cylinder 20 may be activated to slide a locking pin through the recess 12 to a position behind the pin 13.

Figure 3:
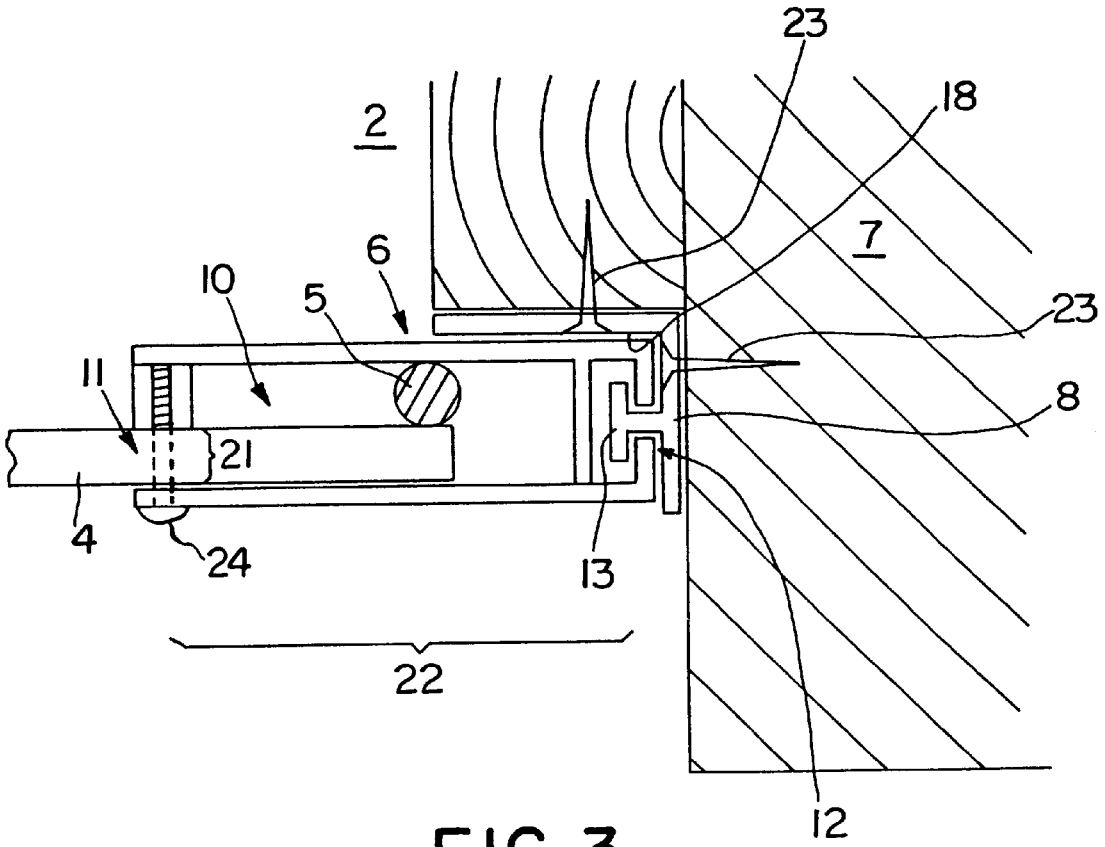
FIG. 3 shows a partial section view of a security grating that is mounted in an opening of a building, likewise shown in cross-section.

The cross section illustrated in FIG. 3 shows that the entry opening 11 has a width 21 corresponding to the thickness of the horizontal bars 4. Furthermore, it will be appreciated that the recess 10 has a depth 22. This depth corresponds to half the mesh width 9, but may also be bigger. The mounting frame 8 is secured to the building by means of screws 23. These screws cannot be removed once the security grating is secured into place upon the mounting frame, as the frame member 6 covers the screws 23 which are placed in the flange 18. In FIG. 3 the pin 13 is formed as an integral flange on the mounting frame 8.

To prevent mutual displacement of the mesh 3 and the frame members 4 a screw 24 is placed in the frame member 6. The screw 24 does not prevent a mutual horizontal displacement of the mesh. Thus, the mesh 3 may be horizontally displaced to allow the outermost single vertical bar 5, as shown in FIG. 3, to be slidably moved along the extent of the depth of the recess 10. However, the mesh and the frame member cannot be vertically displaced on account of the screw 24. A number of screws that are thought appropriate may be employed in a given construction. At the same time, the screws 24 will help to buttress the frame member 6 and consequently the security grating's effectiveness against intrusion from outside, i.e. from the upper side, as seen in FIG. 3.

Figure 4:
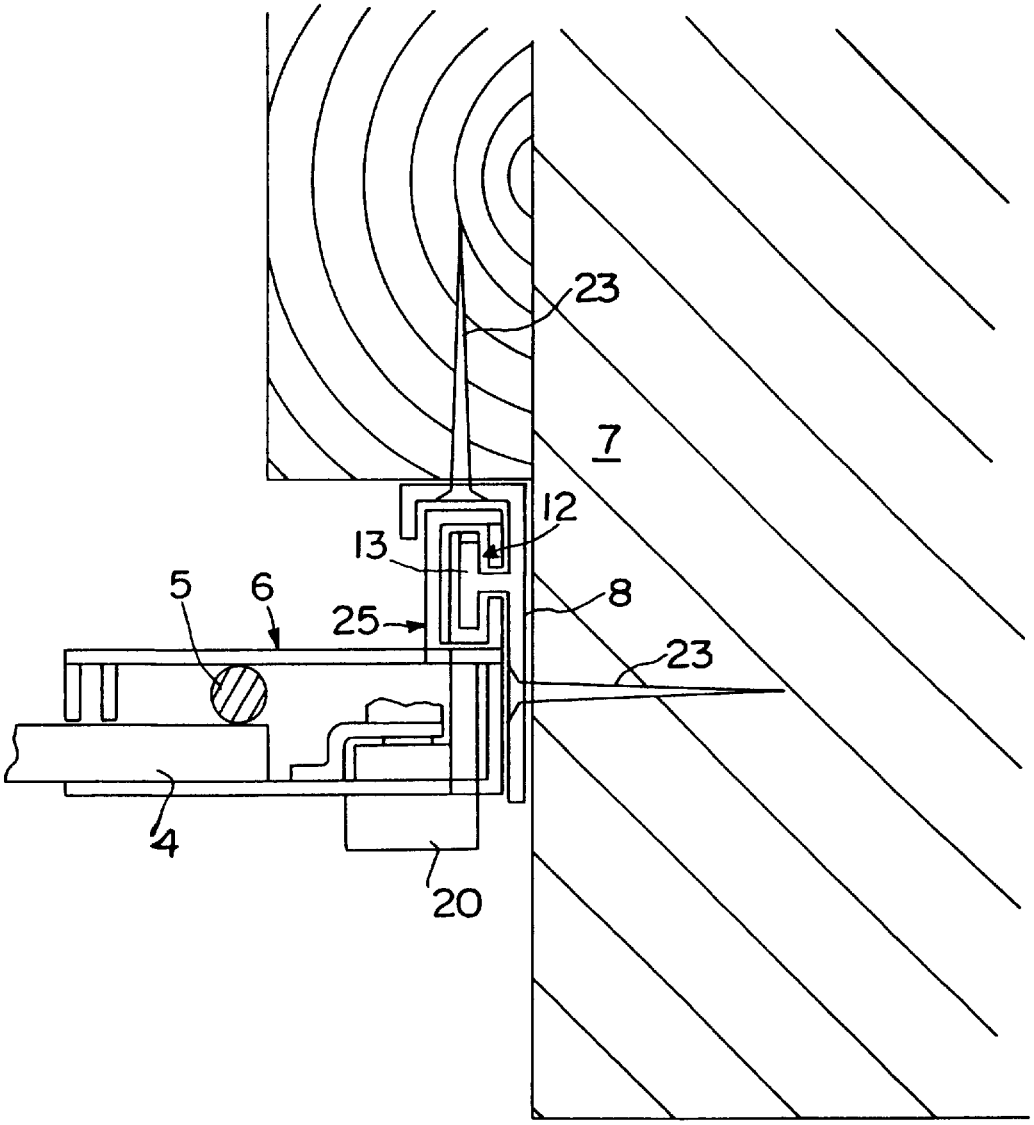
FIG. 4 shows a partial view of a second embodiment of a frame member, that forms part of a security grating according to the invention.

FIG. 4 shows an embodiment that differs from the embodiment shown in FIG. 3 in that the recess 12 is made in a side flange 25. This makes it possible to manufacture the frame member 6 with a smaller extension in the plane of the building and consequently with a smaller coverage of the window opening 2. As this embodiment corresponds to the one shown in FIGS. 2 and 3, it will not be explained in detail.

Figure 5:
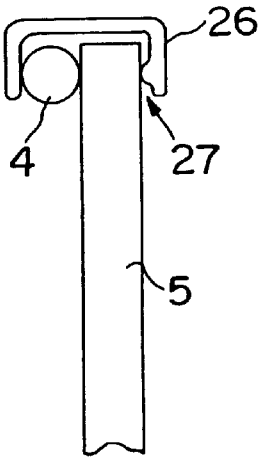
FIG. 5 shows a partial section view similar to FIG. 3 illustrating a covering member, to be used at the top side and under side of the security grating.

FIG. 5 shows a covering member 26, manufactured from plactic and adapted to be placed as horizontal coverings at the top side and the bottom side of the mesh 3. The covering member 26 has a central track 27 which may be placed elastically over the ends of the vertical bars and over the outermost horizontal bars at the top and at the bottom of the mesh 3.

Figure 6:
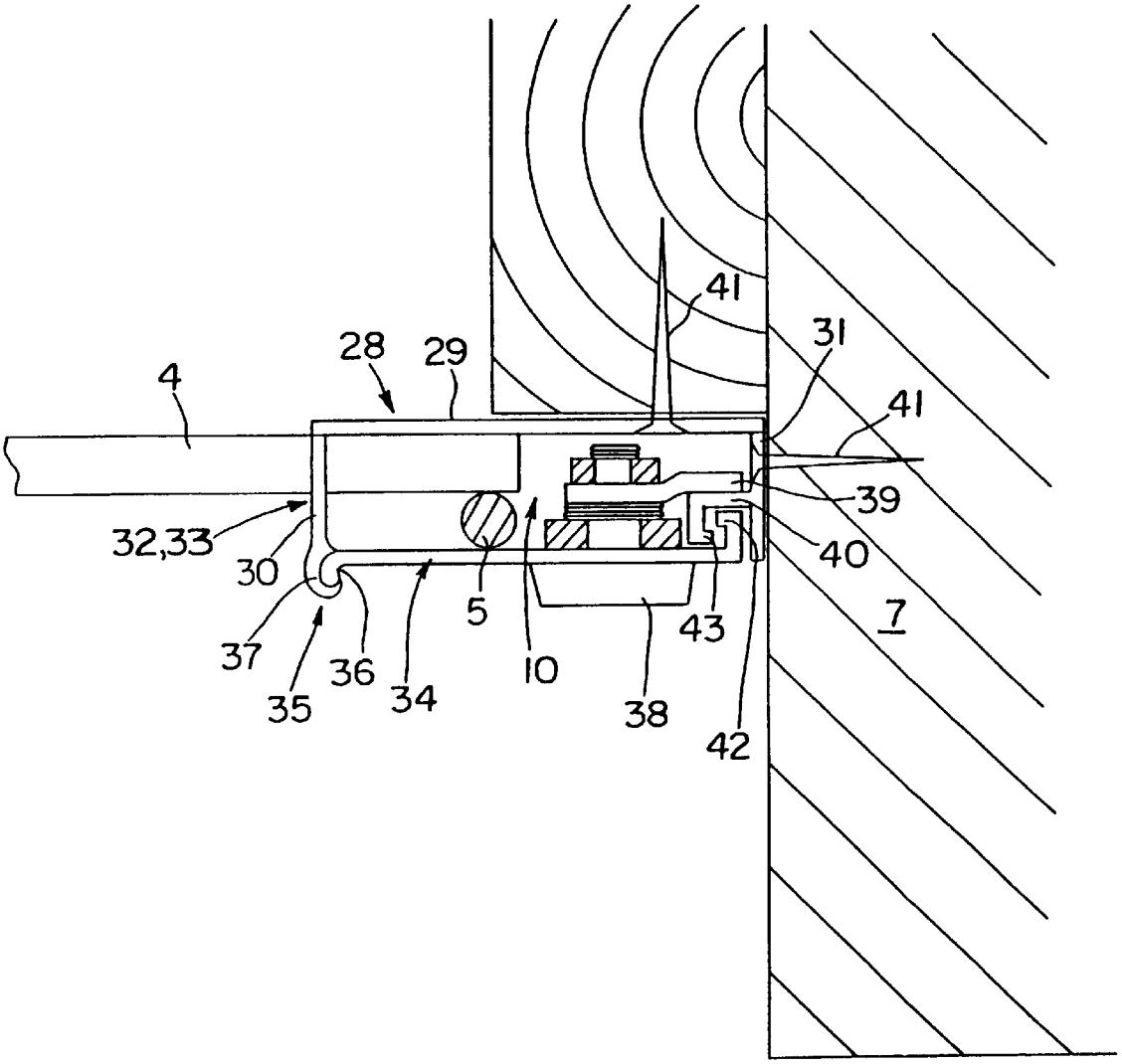
FIG. 6 shows a partial cross section of a second similar to FIG. 3 embodiment of a security grating according to the invention, FIG. 7 a partial perspective view illustrating the frame member shown in FIG. 6.
Figure 7:
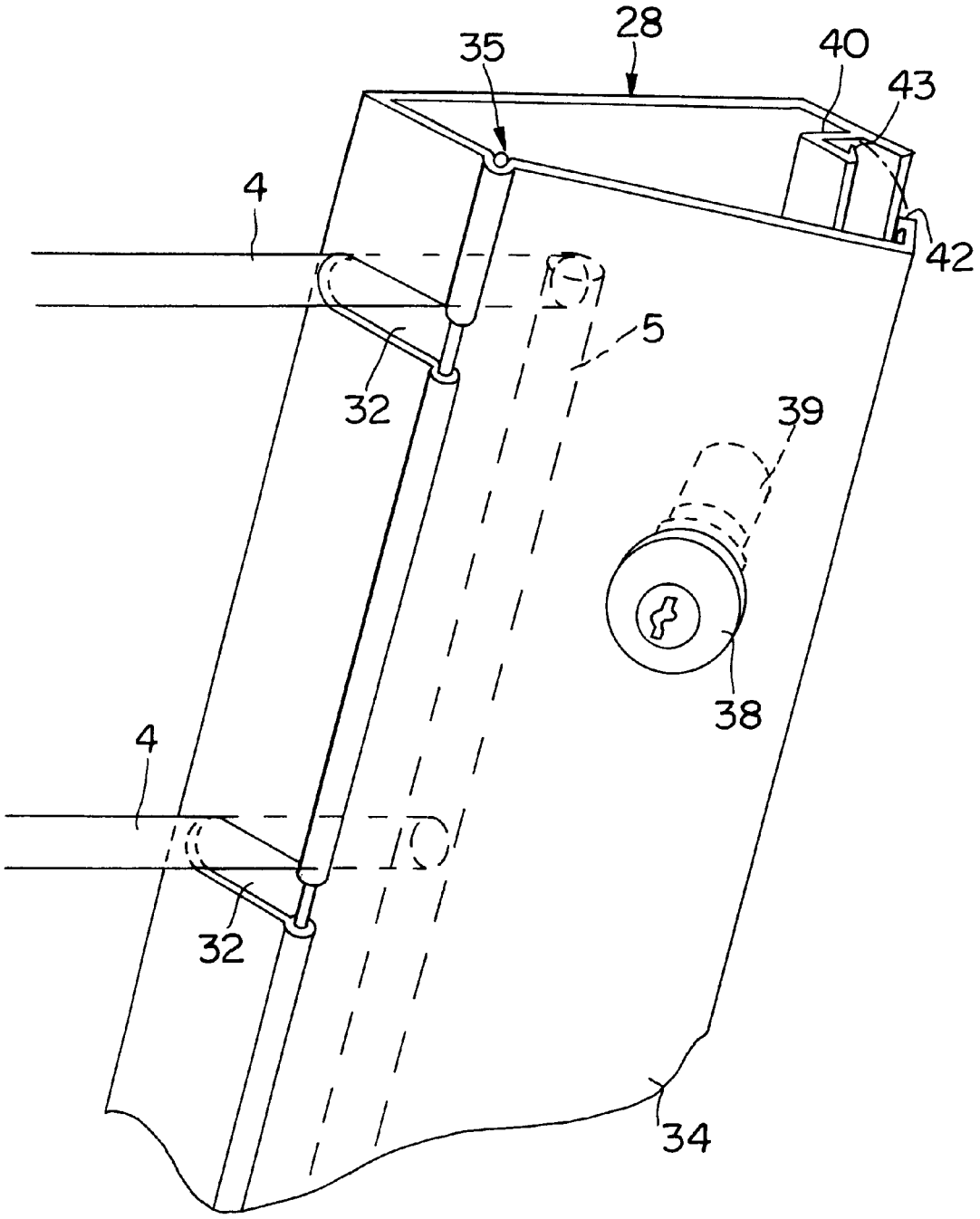
Figure 8:
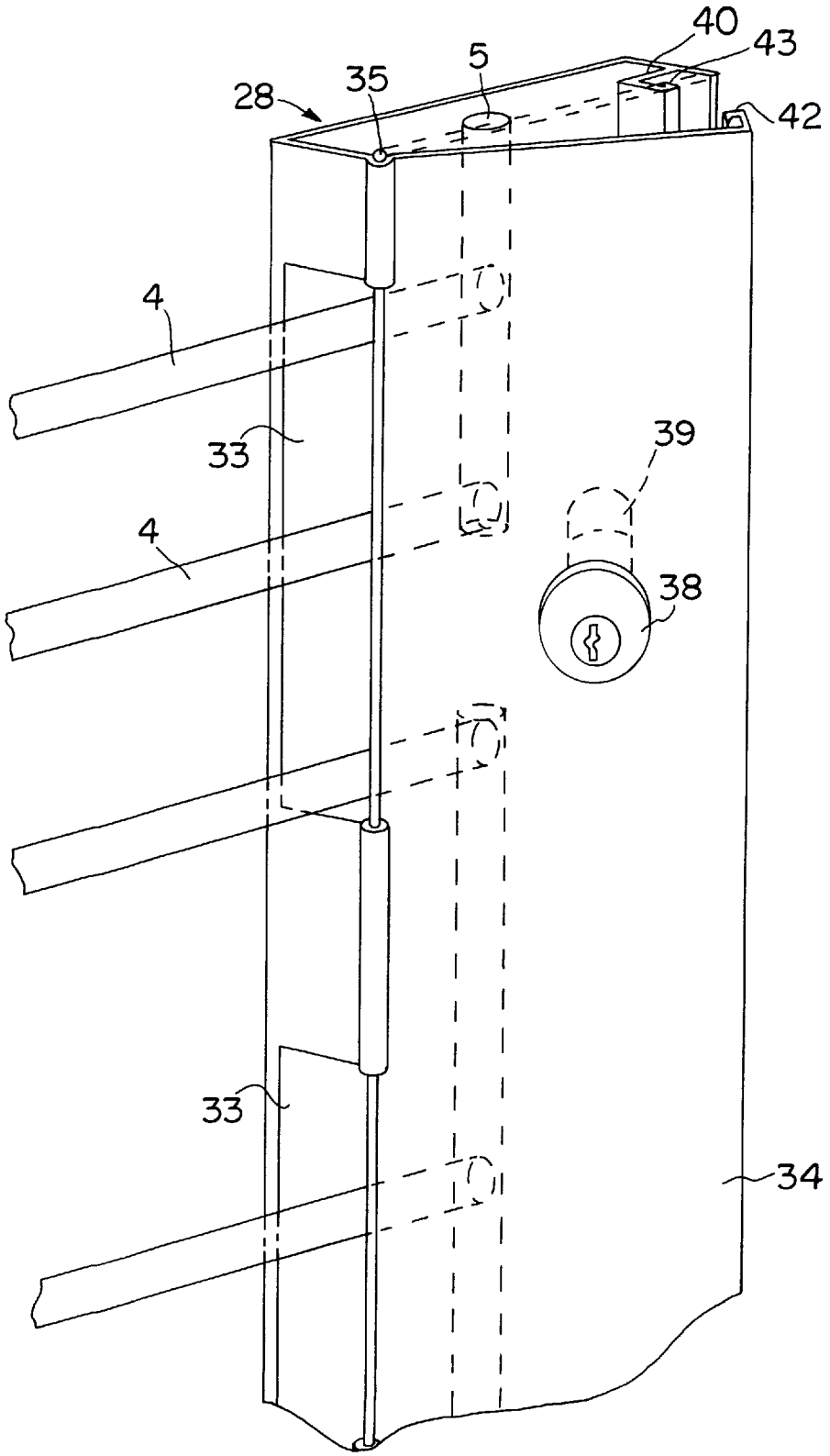
FIG. 8 is a perspective view illustrating yet another embodiment of a frame member according to the invention.

FIGS. 6–8 show two other embodiments of a security grating according to the invention. For both embodiments a vertical frame member 6 is used which is made up of a U-shaped channel member 28. The U-shaped channel member 28 has a bottom 29 and two side walls 30, 31 that make up the side branches of the U. The interior of the U makes up the recess 10. In the side wall 30 of the U are openings 32 and 33, respectively, to the recess 10, these openings being adapted to receive the horizontal bars 4. The opening may be adapted for receiving the bars 4 individually, as illustrated in FIG. 7, or be made as an elongated opening that can receive an arbitrary number of horizontal bars 4.

The recess 10 may be closed by means of a lid 34 connected to the U-shaped channel member 28 by a hinge 35. The hinge 35 includes a hook-shaped part 36 on the lid 34 which engages with an undercut recess 37 in the channel member 28.

Thus, on opening the lid 34 it is released from the side wall 30 of the channel member 28. When closed, the lid 34 may be locked to the channel member by use of a lock 38 including a lock flange 39 adapted to be turned to engage with lock flanges 40 on the side wall 31 of the channel member 28. The channel member 28 is secured to the building using screws 41. The screws 41 are positioned inside the channel member and consequently, cannot be removed once the security grating is fitted into place and locked.

The shape of the lid 34 helps to prevent intrusion from outside. If a person. breaks through a window and places a crowbar between the mesh 3 and the frame member 28 and tries to break the mesh from the frame member, then hook-shaped projections 42 on the lid 34 and a recess 43 on the channel member 28 will be squeezed into firm engagement, making further intrusion difficult.

What is claimed is:

1. A security grating for wall openings in a building comprising:

a frame support to be secured to the building;

a grating including first and second groups of intersecting bars each having a corresponding thickness, the first group of bars being substantially equally spaced apart at a selected mesh width and including end bars respectively located within one half said mesh width of respective lateral edge portions of said grating;

a frame for connection to the frame support, said frame including at least two frame members each having an elongated recess for respectively loosely receiving the end bar of the respective lateral edge portion of the grating, each elongated recess having selected dimensions including an interior depth corresponding to half the mesh width, an interior width corresponding to the thickness of the groups of intersecting bars, and an entry opening corresponding to the thickness of the bars of the second grip of bars, thus enabling adjustment of each frame member relative to the respective lateral edge of the grate, and connecting means adapted to connect the frame to the frame support.

2. A security grating according to claim 1, wherein the frame support has a frame support recess and the connecting means comprises a projecting pin for connection with the frame support recess.

3. A security grating according to claim 2, wherein the elongated recess and the frame support recess are diametrically opposed.

4. A security grating according to claim 2, wherein the frame support recess receives the connecting means.

5. A security grating according to claim 2 further including a lock cylinder and a connecting pin, the lock cylinder cooperating with the frame support, and in a locked position extending across the elongated recess to a position behind the cooperating connecting pin.

6. A security grating according to claim 2, wherein the frame support recess is inclined relative to a plane where the grating is located in use, so that the grating is forced downwards by its own weight and into contact with the frame support.

7. A security grating according to claim 1, wherein each frame member comprises an extrusion, the elongated recess being substantially d-shaped and the entry opening being located at one side of the elongated recess.

8. A security grating according to claim 1, wherein the grating comprises welded round bars.

9. A security grating according to claim 8, wherein the mesh width is about 10 cm.

10. A security grating according to claim 1 including a screw located through an opening in the elongated recess to prevent a mutual displacement of the frame member and the grating.

11. A security grating according to claim 1 wherein the first group of bars is parallel to the frame members and the second group of bars is perpendicular to the frame members.

12. A security grating according to claim 1 wherein the first group of bars is disposed vertically and the second group of bars is disposed horizontally and the frame members are disposed vertically.

13. A security grating according to claim 12, wherein the vertical frame members are each formed of a U-shaped channel member with openings for receiving the horizontal bars in one of the side walls of the U shaped channel, wherein the interior of the U shaped channel forms the elongated recess, a lid for closing the elongated recess, a releaseable hinge for the lid located at a side wall of the U shaped channel, said side wall having openings for receiving the horizontal bars, and wherein the lid, when closed, can be locked to close the U-shaped channel.

14. A security grating according to claim 1 wherein the entry opening is disposed for receiving the lateral portions of the grating in a direction parallel thereto.

15. A security grating according to claim 1, wherein the bars of said second group of bars extend through said entry opening into the recess of each respective frame member.

* * * * *

UNITED STATES PATENT AND TRADEMARK OFFICE

CERTIFICATE OF CORRECTION

PATENT NO. : 5,956,900
DATED : September 28, 1999
INVENTOR(S) : Mogens Madsen

It is certified that error appears in the above-identified patent and that said Letters Patent is hereby corrected as shown below:

Title page, item [73], Assignee: delete Abonnmentservice and insert -- Abonnementservice --.

Signed and Sealed this

Seventh Day of March, 2000

*Attest:*

*Attesting Officer*

Q. TODD DICKINSON

*Commissioner of Patents and Trademarks*